US006698035B1

(12) United States Patent
Grueser

(10) Patent No.: US 6,698,035 B1
(45) Date of Patent: Mar. 2, 2004

(54) URINAL ANTI-SPLASHBACK SCREEN

(76) Inventor: John S. Grueser, 1001 26th St. NW., #601, Washington, DC (US) 20037-1604

( * ) Notice: Subject to any disclaimer, the term of this patent is extended or adjusted under 35 U.S.C. 154(b) by 0 days.

(21) Appl. No.: 10/226,302

(22) Filed: Aug. 23, 2002

(51) Int. Cl.[7] ..... E03D 13/00
(52) U.S. Cl. ..... 4/301; 4/309
(58) Field of Search ..... 4/300.3, 309, 222.1, 4/301; 210/359

(56) References Cited

U.S. PATENT DOCUMENTS

| | | | | |
|---|---|---|---|---|
| 487,130 A | | 11/1892 | Schoen | |
| 571,275 A | | 11/1896 | Maxwell et al. | |
| 647,895 A | | 4/1900 | Burson | |
| 1,186,345 A | | 6/1916 | Sleight | |
| 3,648,298 A | * | 3/1972 | Gross | 4/305 |
| 5,313,672 A | | 5/1994 | Leudtke et al. | |
| 5,604,937 A | | 2/1997 | Davenport | |
| D393,896 S | | 4/1998 | Wagner et al. | |
| 5,809,590 A | * | 9/1998 | Williams et al. | 4/661 |

FOREIGN PATENT DOCUMENTS

| | | | | |
|---|---|---|---|---|
| CH | 191199 | * | 8/1937 | 4/309 |
| DE | 1802407 | * | 5/1970 | 4/309 |

* cited by examiner

*Primary Examiner*—Charles E. Phillips
(74) *Attorney, Agent, or Firm*—Richard C. Litman

(57) ABSTRACT

A protective screen which fits over the opening of a urinal to prevent splashback that commonly occurs when a stream of urine contacts the inside wall of the urinal. The screen functions to allow a stream of urine to pass therethrough but prevents the occurrence of splashback when the urine stream contacts the walls of the urinal or the water at the bottom of the urinal. The screen also provides a filter to prevent foreign articles (paper, gum, cigarette butts, etc.) from being flushed down the urinal. The screen is positioned in the urinal such that flush water flows over the entire surface of the screen thereby cleansing the surface and enhancing sanitary conditions.

8 Claims, 4 Drawing Sheets

URINAL ANTI-SPLASHBACK SCREEN

BACKGROUND OF THE INVENTION

1. Field of the Invention

The present invention generally relates to restroom accessories. More specifically, the present invention is drawn to an accessory for use with a urinal.

2. Description of the Related Art

In most public restrooms, the use of the urinal often results in creating an annoying and unsanitary situation, in that splashback from the urinal contacts the person using the urinal. The user must then employ a paper towel in an attempt to wipe away the splashback or live with the knowledge that the smelly, germ-ridden fluids are absorbed by his clothes. Either scenario is unpleasant, to say the least.

There have been attempts to alleviate this problem. For example, U.S. Pat. Nos. 487,130 (Schoen), U.S. Pat. Nos. 571,275 (Maxwell et al.), U.S. Pat. Nos. 647,895, (Burson) and U.S. Pat. Nos. 1,186,345 (Sleight) are drawn to urinals having protective screens. It is noted however, that the screens are not positioned in a manner to have their entire surface: areas cleansed by flush water. U.S. Pat. Des. No. 393,896 (Wagner et al.), U.S. Pat. Nos. 5,313,672 (Luedtke et al.) and U.S. Pat. Nos. 5,604,937 (Davenport) disclose screens positioned at the bottom of a urinal. The screens do not extend over an area large enough to prevent splashback.

German Patent 281,964 (Kastner) shows a screen whose entire surface area is contacted by flush water. The screen does not prevent the deposit of rubbish which could cause blockage in the urinal outflow line.

None of the above inventions and patents, taken either singularly or in combination, is seen to disclose a urinal screen as will subsequently be described and claimed in the instant invention.

SUMMARY OF THE INVENTION

The invention is drawn to a screen, which screen fits over the opening of a urinal to prevent splashback that commonly occurs when a stream of urine contacts the inside wall of the urinal. The splashback effect often extends outside the confines of the urinal and contacts the user's clothing and skin. Furthermore, the floor and any immediately adjacent walls may be subject to the deposit and buildup of urine thereon, thereby resulting in malodorous, unsightly and unsanitary conditions.

The screen of the instant invention functions to allow a stream of urine to pass therethrough but prevents the occurrence of splashback when the urine stream contacts the walls of the urinal or the water at the bottom of the urinal. The screen also provides a filter to prevent foreign articles (paper, gum, cigarette butts, etc.) from being flushed down the urinal, thereby causing expensive plumbing damage. The screen also serves as a visual barrier, preventing the user from viewing the unsightly appearance of the deodorizing cake and accumulated water at the bottom of the urinal. The screen is positioned in the urinal such that flush water flows over the entire surface of the screen cleansing the surface and enhancing sanitary conditions.

Accordingly, it is a principal object of the invention to provide a urinal screen, which screen is effective to prevent urine splashback.

It is another object of the invention to provide a urinal screen, which screen is effective to prevent solid debris form being deposited at the bottom of the urinal.

It is a further object of the invention to provide a urinal screen, which screen positioned in the urinal such that the entire, surface area of the screen is contacted with flushing water.

Still another object of the invention is to provide a urinal screen, which screen functions to form a barrier preventing a user from viewing the unsightly inside bottom portion of a urinal.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
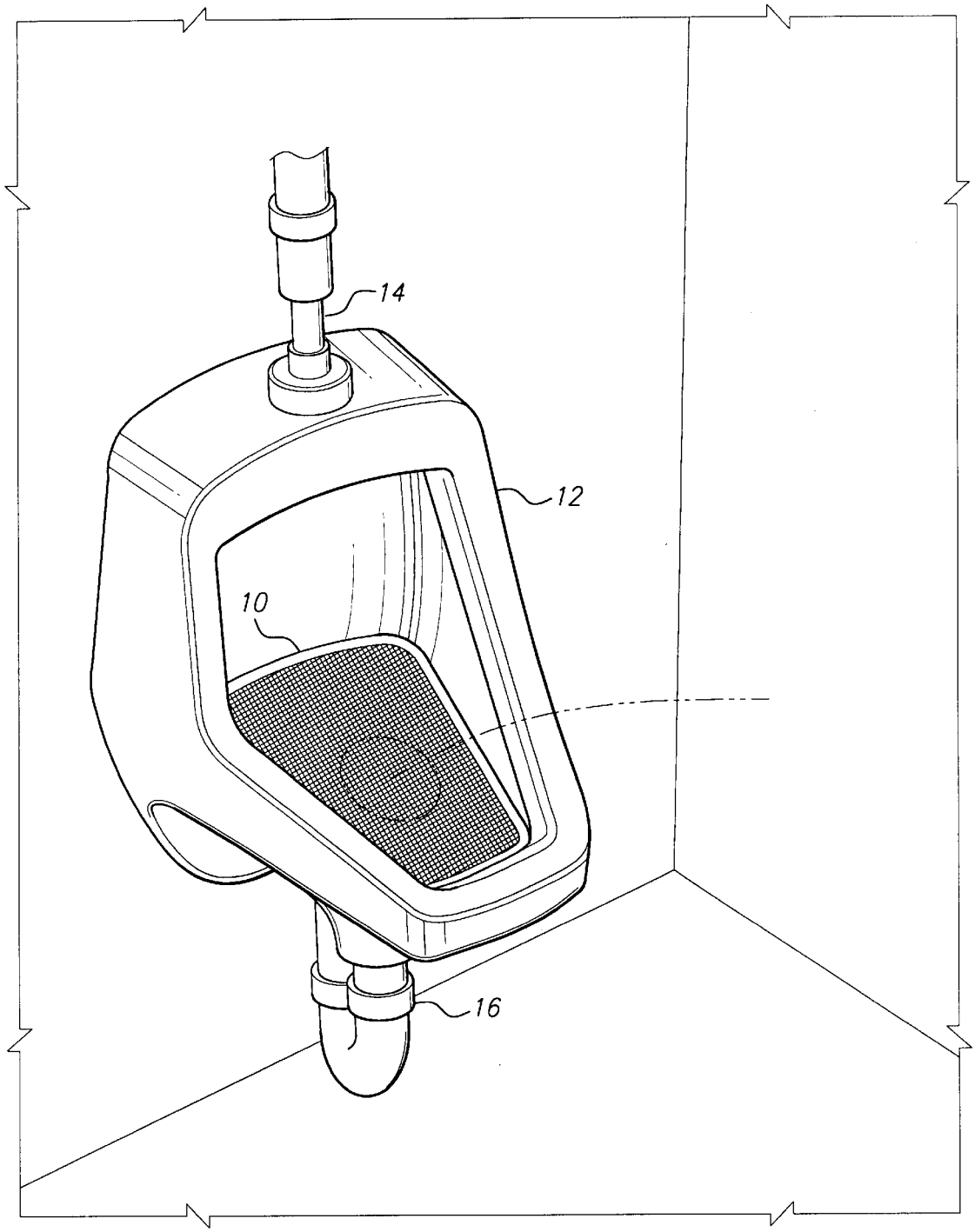
FIG. 1 is an environmental, perspective view of a urinal anti-splashback screen, according to the present invention.
Figure 2:
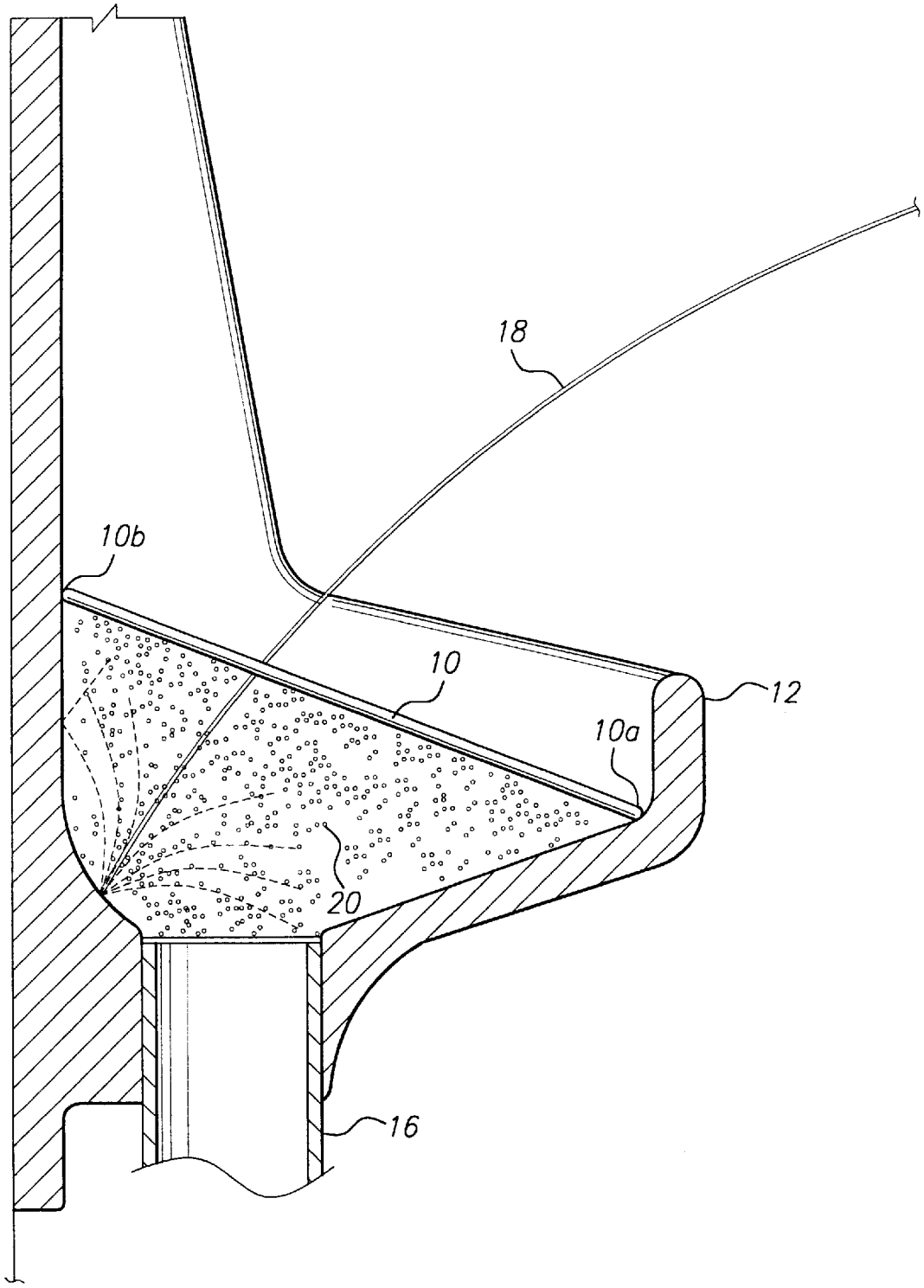
FIG. 2 is a sectional view of a urinal anti-splash back screen showing splash back prevention, according to the present invention.
Figure 3:
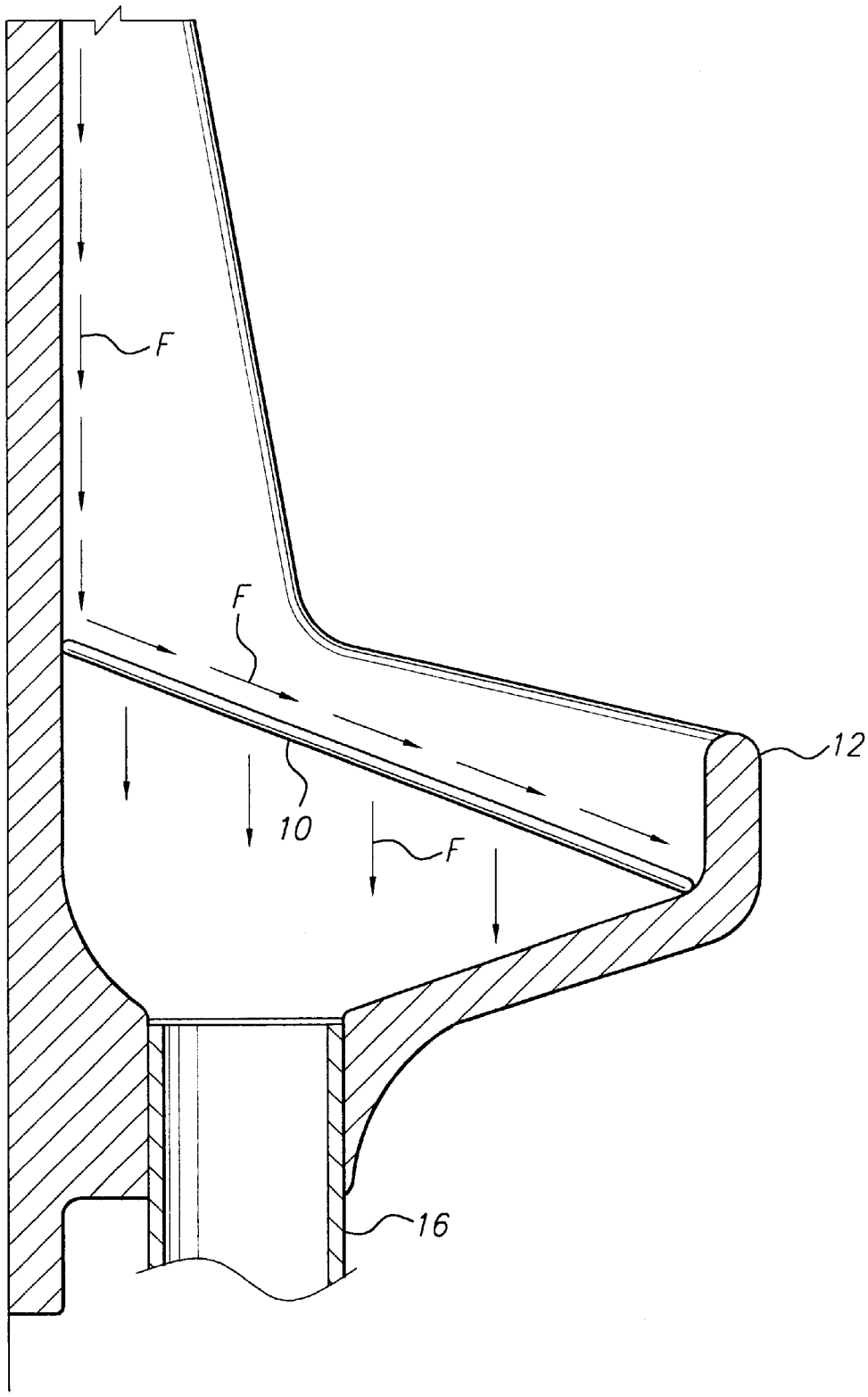
FIG. 3 is a sectional view of a urinal anti-splash back screen showing flush water flow, according to the present invention.

Attention is directed to FIGS. 1–3 which illustrate the screen 10 of the instant invention disposed in the bowl 12 of a urinal. Bowl 12 is provided with an upper surface which has an inlet 14 therein for flush water. An outlet 16 communicates through the bottom of bowl 12 for drainage. Screen 10 is fabricated from a non-corrosive, narrow-gauge threads (steel, aluminum, plastic, etc.) to prevent rusting and/or degradation. The interstices in the mesh created by weaving the narrow-gauge threads are sufficiently large to allow a stream of urine 18 to pass therethrough and enter the bowl, but small enough to prevent droplets 20 from passing beyond the confines of the bowl. Screen 10 is positioned in bowl 12 such that a front edge 10*a* is disposed inside the extending front portion of the bowl. A rear edge 10*b* abuts the rear wall of the bowl. Rear edge 10*b* is positioned vertically above front edge 10*a* so that the screen is positioned at an angle in the bowl. The screen is shaped and sized so that it is in abutment with all the inside walls of the bowl. This arrangement will permit flush water F to contact the entire surface area of the screen each time the urinal is flushed. The screen may be provided with a logo such as a target as shown in FIG. 1. The logo or target would be particularly effective in encouraging children or, for that matter, any user to focus their attention on, the screen. A temperature-sensitive, color-changing paint is also contemplated as means to encourage a user to focus attention on the, screen.

Figure 4:
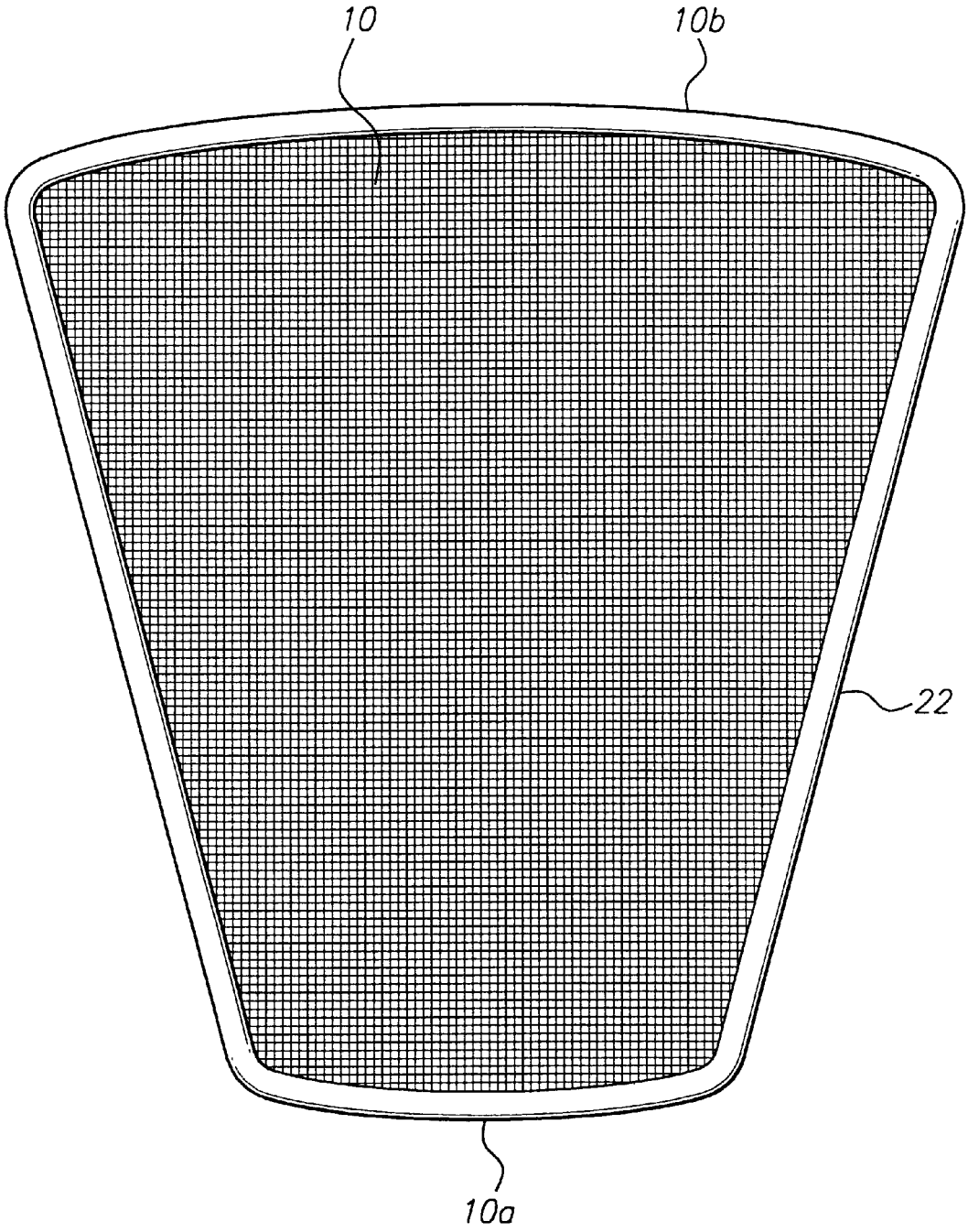
FIG. 4 is a plan view of an anti-splash back screen, according to the present invention.

The perimeter of the screen is encased in a thin, solid metal or plastic band 22 to prevent the threads from separating (FIG. 4). Although illustrated as a trapezoid, it is recognized that the screen may be fabricated in any size or shape so as to conform to, the many urinal sizes and configurations. The screen may also have a convex or concave profile as desired.

It is to be understood that the present invention is not limited to the embodiment described above, but encompasses any and all embodiments within the scope of the following claims.

I claim:

1. A combination urinal and anti-splashback screen comprising:

a bowl defining a urinal, said bowl having a lower front portion, a rear inside vertical wall having an upper end, side walls, an upper surface and a bottom surface;

a liquid supply conduit extending through said upper surface and opening into said bowl at said upper end of said inside vertical wall;

a drain conduit extending through said bottom surface and opening into said bowl;

a mesh screen disposed in said bowl, said mesh screen being spaced from said bottom surface of said bowl, said mesh screen having a surface area, a front edge, a rear edge and side edges;

said front edge of said mesh screen in abutment with said lower front portion of said bowl;

said rear edge of said mesh screen in abutment with said vertical rear wall of said bowl at a distance vertically above said front edge and at a distance vertically below said upper end of said vertical rear wall, whereby liquid from said supply conduit contacts the entire surface area of said mesh screen; and said side edges of said mesh screen in abutment with said side walls of said bowl.

2. A combination urinal and anti-splashback screen as recited in claim 1, wherein said screen has a perimeter and includes a thin solid band encasing said perimeter.

3. A combination urinal and anti-splashback screen as recited in claim 2 wherein a logo is inscribed on said surface area of said screen.

4. A combination urinal and anti-splashback screen as recited in claim 3, wherein said mesh and said band are fabricated from a metallic material.

5. A combination urinal and anti-splashback screen as recited in claim 3, wherein said mesh and said band are fabricated from a plastic material.

6. A combination urinal and anti-splashback screen comprising:

a bowl defining a urinal, said bowl having a lower front portion, a rear inside vertical wall having an upper end, side walls, an upper surface and a bottom surface;

a liquid supply conduit extending through said upper surface and opening into said bowal at said upper end of said inside vertical wall;

a drain conduit extending through said bottom surface and opening into said bowl;

a mesh screen disposed in said bowl, said mesh screen having an upper surface, said upper surface painted with a temperature sensitive paint, a front edge, a rear edge and side edges, said mesh screen spaced above said bottom surface;

said front edge of said mesh screen in abutment with said lower front portion of said bowl;

said rear edge of said mesh screen in abutment with said vertical rear wall of said bowl at a distance vertically above said front edge and at a distance vertically below said upper end of said vertical rear wall, whereby liquid from said supply conduit contacts the entire upper surface of said mesh screen; and said side edges of said mesh screen in abutment with said side walls of said bowl.

7. A combination urinal and anti-splashback screen as recited in claim 6, wherein said mesh screen is fabricated from a metallic material.

8. A combination urinal and anti-splashback screen as recited in claim 6, wherein said mesh screen is fabricated from a plastic material.

* * * * *